US007021606B2

(12) United States Patent
Raycraft

(10) Patent No.: US 7,021,606 B2
(45) Date of Patent: Apr. 4, 2006

(54) VERTICAL PANEL LIFT

(76) Inventor: Marc E. Raycraft, 4564 Arborwalk Ct., Stone Mountain, GA (US) 30083

( * ) Notice: Subject to any disclaimer, the term of this patent is extended or adjusted under 35 U.S.C. 154(b) by 0 days.

(21) Appl. No.: 10/702,952

(22) Filed: Nov. 6, 2003

(65) Prior Publication Data

US 2005/0098769 A1 May 12, 2005

(51) Int. Cl.
*B66D 1/00* (2006.01)

(52) U.S. Cl. ..... 254/329; 254/332; 414/11; 52/127.2

(58) Field of Classification Search ..... 254/329, 254/332–335; 414/10, 11; 212/901; 52/127.2
See application file for complete search history.

(56) References Cited

U.S. PATENT DOCUMENTS 2,815,132 A * 12/1957 Stone ..... 414/11
4,706,939 A * 11/1987 Gagne ..... 254/332
5,303,899 A 4/1994 Palya
5,460,469 A 10/1995 Young
5,551,528 A 9/1996 Vieito
5,640,826 A 6/1997 Hurilla, Jr.
5,797,504 A * 8/1998 Mangum ..... 212/303
5,833,430 A 11/1998 Reynolds et al.
6,089,809 A 7/2000 Dellinger
6,244,810 B1 6/2001 Reyes
6,308,969 B1 * 10/2001 Young ..... 280/79.7
6,481,694 B1 * 11/2002 Kozak ..... 254/325
6,508,448 B1 1/2003 Stewart
6,599,078 B1 * 7/2003 Elder ..... 414/542
2002/0159863 A1 10/2002 Ray
2003/0039531 A1 2/2003 Bickle

* cited by examiner

*Primary Examiner*—Emmanuel M. Marcelo
(74) *Attorney, Agent, or Firm*—Myers & Kaplan, LLC; Barry E. Kaplan, Esq.

(57) ABSTRACT

The present invention is a lightweight apparatus related generally to lifting heavy objects of construction materials by a single individual, such as panels of sheetrock to inside or outside walls, easily accommodating walls up to 12 feet in height, including angled walls. It is more particularly directed to raising panels of sheetrock to upper portions of a wall and holding the panel in place while an individual nails or screws the sheetrock to the wall studs. A triangular sling-like attachment secures a panel of drywall being lifted by turning the winch. Another attachment on the top section allows the apparatus to lean against the studded wall. The vertical panel lift allows the worker to handle with ease drywall panels that are ¼", ⅜", ½" and ⅝" thick, in addition to holding in place drywall panels as large as 54" wide and 16 feet long.

11 Claims, 4 Drawing Sheets

VERTICAL PANEL LIFT

BACKGROUND OF THE INVENTION

1. Field of the Invention

The present invention relates generally to lifting heavy objects of construction materials by a single individual, such as panels of sheetrock or other construction materials to inside or outside walls.

This invention is more particularly directed to an easier manner in which to raise a panel of sheetrock or other construction material to the top portion of a wall to hold in place to an upper portion of an inner wall.

This invention is even more particularly directed to an easier manner in which to hold the panel of sheetrock in place by a single individual so as to nail or screw the panel of sheetrock to the wall.

2. Description of Prior Art

In the past, in order to place just one panel of drywall to an upper portion of a wall, it has been routine and necessary for two or three people to hold a panel of drywall to the upper wall of a normal wall height (8 to 9 feet) in order to nail or glue the panel to the wall. It is generally awkward and virtually impossible for one person to hold a heavy panel of sheetrock in position and nail the panel of drywall at the same time, since drywall is typically pushed up to the ceiling for a tight fit.

A second working condition which has given rise to a specialized tool feature is a need to meet consumers who want higher ceilings, i.e., cathedral ceilings, 9 to 12 foot ceilings, commercial buildings, etc. In this situation, placing panels of sheetrock to the higher areas may be limited and hazardous. There are a few designs of construction lifting apparatus that have been created to allow a user to lift or move a heavy object, such as drywall panels and glass, which may be lifted to a height where they may be transferred onto a panel lifter having an extended height capability and are more specifically designed for outer wall use. These tools are often described as devices for lifting and transporting panels.

One type of prior art utilizes a lift platform with a pair of panel-supporting legs of square metal tubing attachable to side rails of a lift platform, with each leg being connected to the rails by an upper clamp at the top of the leg and a lower clamp at a middle location. A panel-receiving U-shaped channel is located on the opposite side of the leg, away from the rails, while the lower clamp has a standoff member included in its connection to the leg serving to project the bottom of the legs outward at an angle. Rollers at the top and bottom provide low-fiction rolling contact for weight bearing surfaces. (Charles T. Ray, U.S. Pat. Application No. 2002/0,159,863).

A second type of prior art device involves the use of an adjustable drywall support apparatus for holding a gypsum wallboard in place as it is being installed at ceiling level, which includes a support assembly of an elongate tubular and shaft members being telescopingly disposed in the elongate tubular member, with a cross member assembly including a tubular main cross member securely attached to the support assembly and adapted to support a drywall panel. (Dennis Stewart, U.S. Pat. No. 6,508,448).

A third type of apparatus provides a mast and a cable-operated winch for pivot-lifting horizontally-manufacture wall frames to the vertical position, utilizing upper and lower sections of 2"×6" lumber to form the length of the mast. Top and bottom mast elements have hollow box sockets, into which the lengths of lumber are telescoped, and a middle mast element carries a winch with the cable hooked to the top rail of the wall frame. This is designed primarily for outside wall use (Douglas B. Reynolds and Lewellyn B. Colbourne, U.S. Pat. No. 5,833,430).

A fourth device for lifting panels by a single individual may cause such panels to be elevated vertically in connection with a structure to a location considerably higher than that which the person is located, without the use of ladders. A frame is mounted and erected vertically and a panel slides upwardly by a winch operation until in position to secured to the structure. Legs may be attached to said frame by which a work table may be provided to work on such panels prior to installation (Jerome C. Palya, U.S. Pat. No. 5,303,899).

Even with these improvements, a need exists for an improved way to install large sheets of sheetrock to inner walls safely by one individual.

A need exists for a device which is mobile, light in weight and easy to use in the construction field to hang sheetrock and other construction materials.

A need exists for a simple, lightweight so as to easily carry the tool to a jobsite, yet effective mechanism to lift sheetrock and hold the panel tight to the wall near the ceiling while fastening the construction panel to the wall.

Furthermore, a need exists for an adjustable tool with an adjustment mechanism having significant holding strength once the desired height is selected.

SUMMARY OF THE INVENTION

The present invention recognizes and addresses the foregoing advantages, and others, of prior art construction and methods.

Accordingly, it is an object of the present invention to provide a lightweight tool which provides an improved method of lifting sheetrock into the desired position on a wall and hold it in place while nailing or gluing it to the wall. The preferred embodiment of this invention utilizes an adjustable easier to use winch, as a part of the lift.

A first advantage of the presently preferred embodiment is that it is adjustable. This lift can be operated by a single person (male or female).

A second advantage is less time spent thereby expediting the completion of construction jobs.

Another advantage of the presently preferred tool is eliminating the need for two or more individuals to complete a job enabling one person to do the same work.

Additional objects and advantages of the invention will be set forth in part in the following description, or may be obvious from the description or accompanying drawings, or may be learned through practice of the invention.

The accompanying drawings, which are incorporated in and constitute a part of this specification, illustrate several embodiments of the invention and together with the description serve to explain the principles of the invention.

Figure 1:
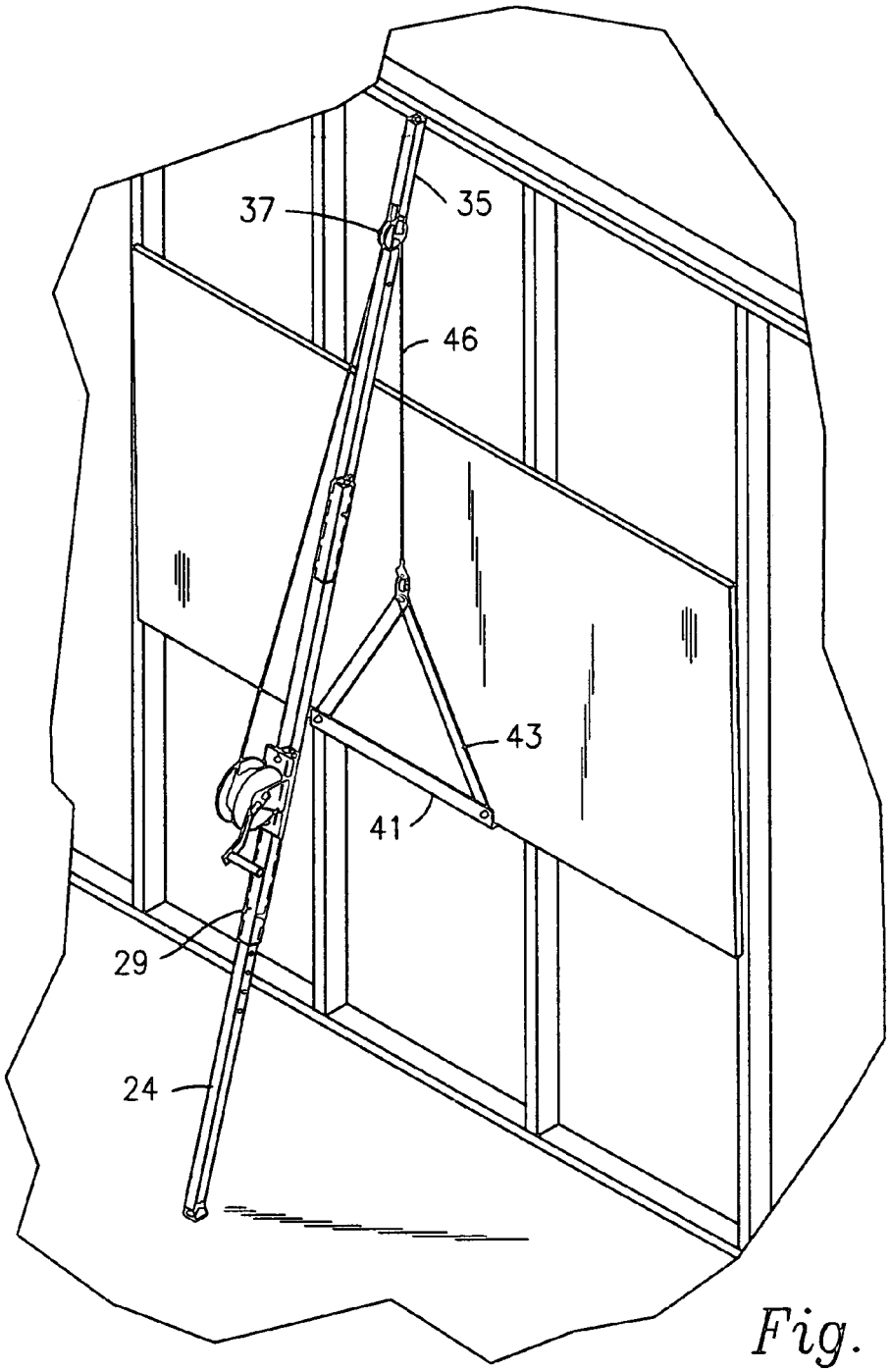
FIG. 1 is a side and back elevation view of the preferred embodiment of the vertical panel lift of the present invention.

Repeat use of reference numerals in the present specification represent like, similar or analogous parts, features or elements of the present invention throughout several views.

DETAILED DESCRIPTION OF THE PREFERRED EMBODIMENTS

Reference will now be made in detail to the presently preferred embodiments of this invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield still a further embodiment. Thus, it is intended that the present invention covers such modifications and variations as come within the scope of the appended claims and their equivalents.

The present invention is concerned with an improved tool, specifically a vertical panel lift which is easy to use and so lightweight (appx. 25 lbs.), that it can be used by one man or woman to accomplish their task of hanging heavy panels of sheetrock (one of which can weigh up to 150 lbs.,) other construction material.

Accordingly, FIG. 1 is a side and back elevation view of a preferred embodiment of the vertical panel lift of the present invention, a triangular cradle or sling-like device. The cradle is designed to lift one piece of sheetrock or other building material.

Figure 2:
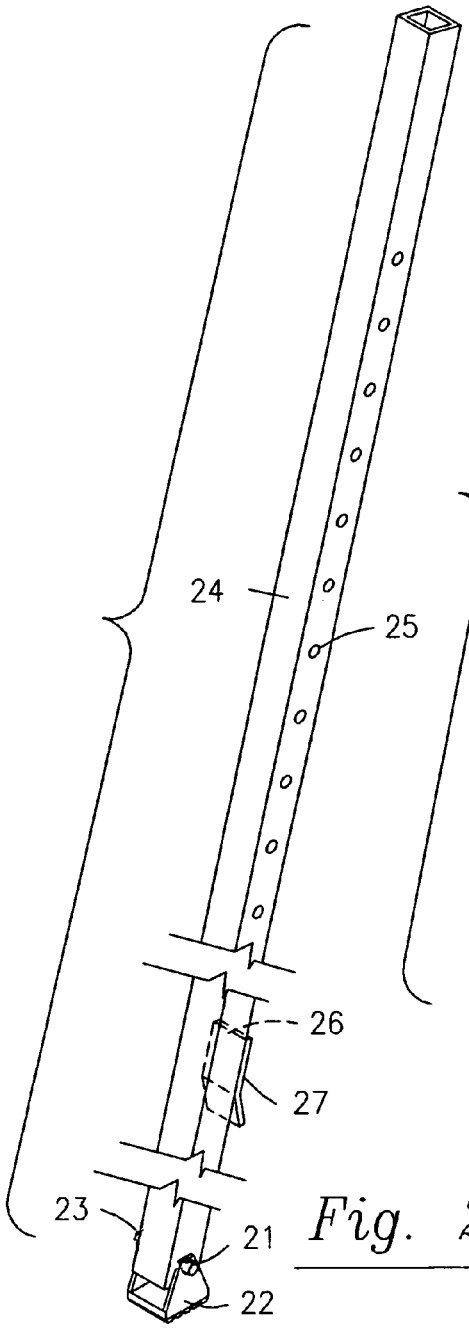
FIG. 2 is a plan view of the preferred embodiment of the present invention showing the central frame member or brace with its base being flush with the floor level.

FIG. 2 is a plan view of the preferred embodiment of the present invention showing the slidable central frame member or brace 24 with its base being flush with the floor level, and which swivels to accommodate various angles. The adjustment hole is in the base part with a clip 26, 27 to hold the sling when not in use or in transporting the tool. The base footing 22 is attached by a nut 23 and bolt 21 to the slidable central frame member which is comprised of steel or square tubing, with adjustable extension holes 25. Holes 25 allow for length adjustment held in place with a pin.

Figure 3:
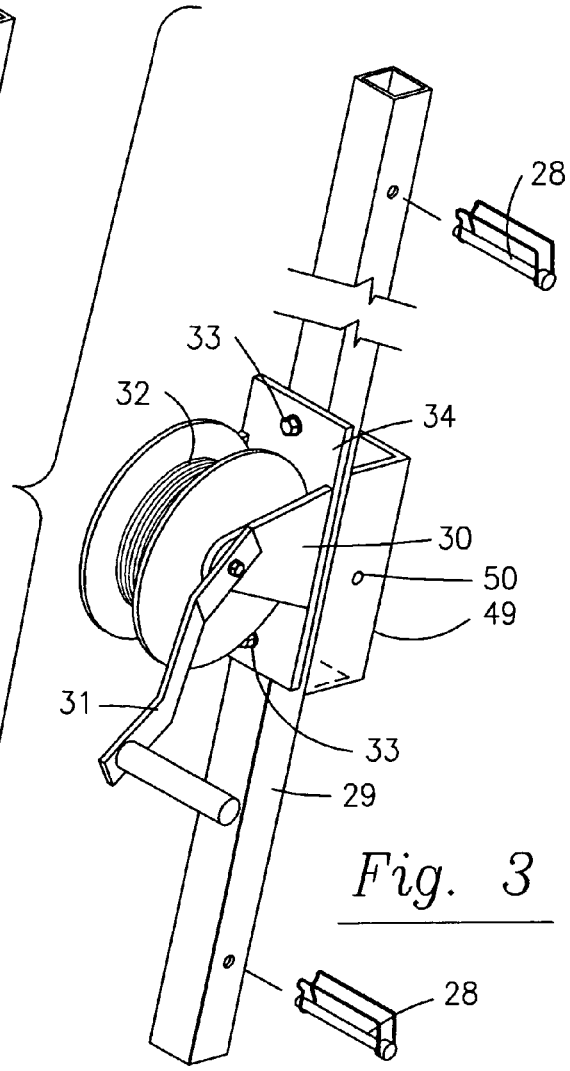
FIG. 3 is a view of the present invention's winching or hoisting element section.

FIG. 3 is a view of the present invention's winching or hoisting element section brace 29, with a single action hand winch 30 having an internal cable lock for raising a panel of sheetrock. The winch is comprised of steel with a one-way ratchet handle 31 which reels the steel wiring cable 32, and is attached by a mounting bracket plate 34 by bolts 33 and is connected to the top and base portions of this invention with steel locking pins 28. A welded section of square tubing for transporting to secure the lower portion of the base section 49 with hole 50 for pinning while in transit.

Figure 4:
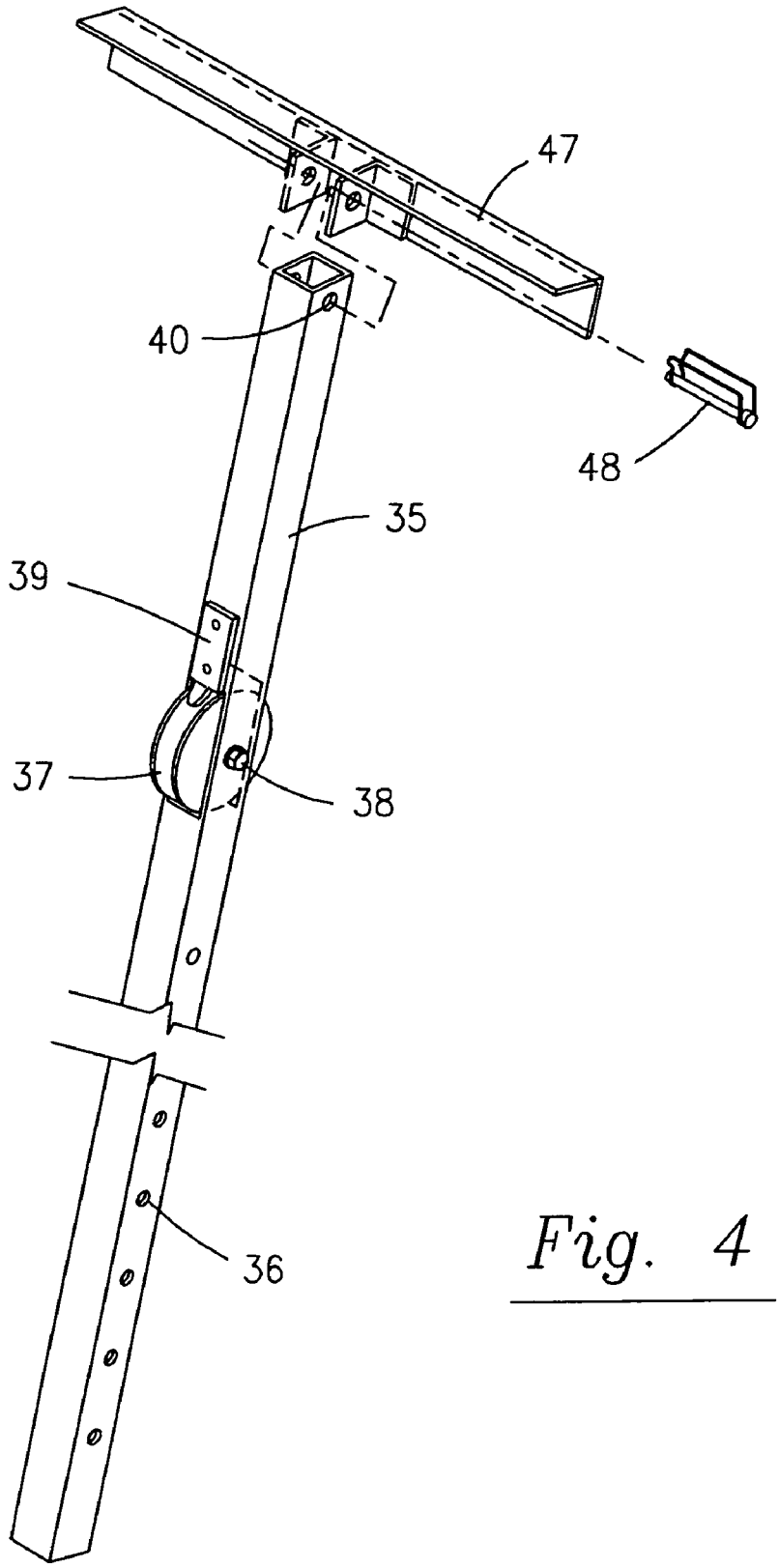
FIG. 4 is a plan view of the sliding mast and pulley section, which is connected to a T-Bar for further attachments.

FIG. 4 is a plan view of the sliding mast and pulley section comprising square tubing or telescoping 35 containing holes 36 for adjusting the height and 40 at the mast's top section to connect to a T-Bar 47 held to the mast by pins 48 for further attachments, if so desired or needed. The pulley 37 holds ⅛" steel cable, and is held in place by a bolt 38 which slides easily inside the winching or hoisting element section of the mast to retain the pulley and contains a retaining clip 39 to secure the cable being held in place by a self-drilling screw.

Figure 5:
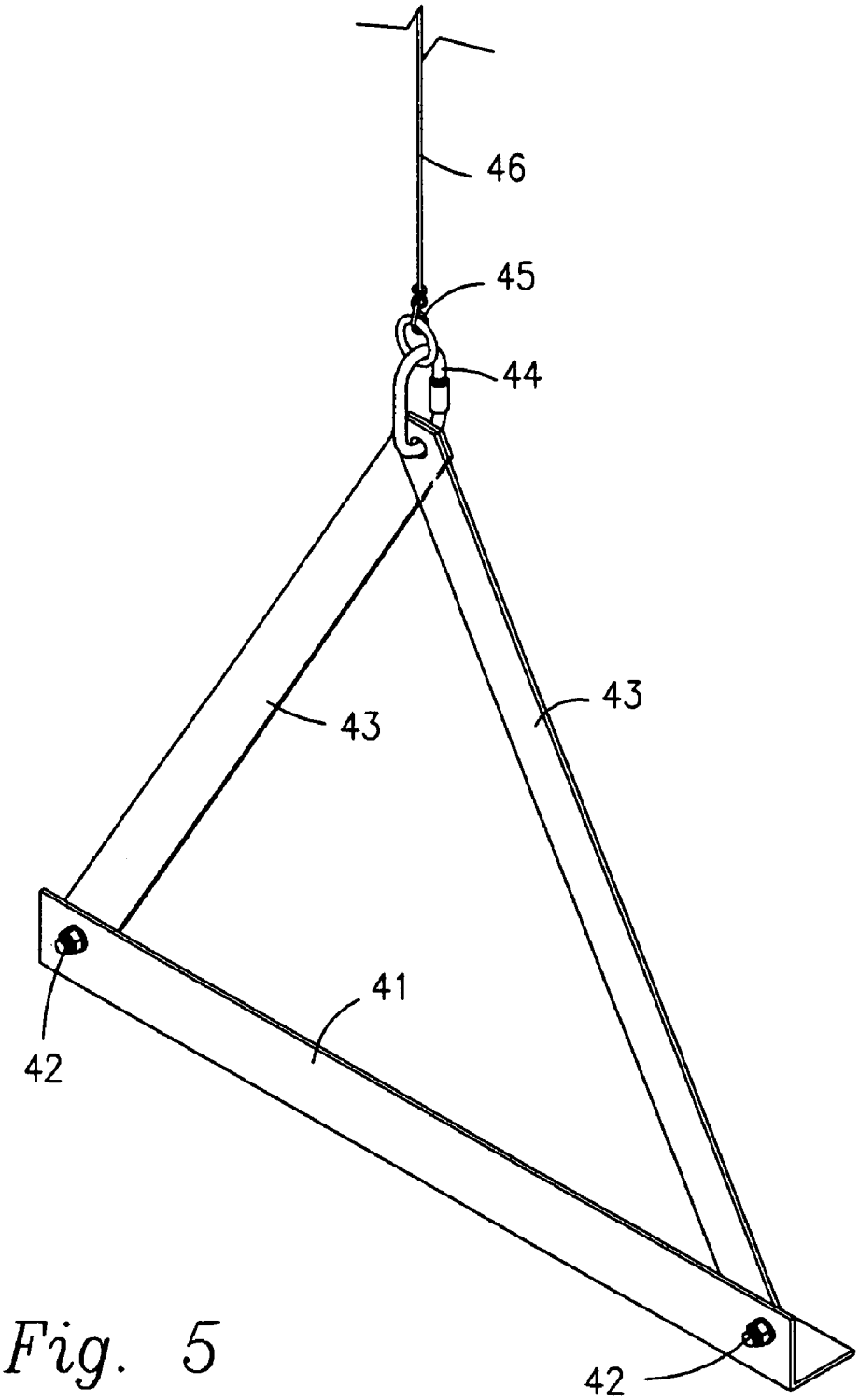
FIG. 5 is a frontal plan view of the triangular cradle or sling which lifts a panel of sheetrock.

FIG. 5 more explicitly visualizes the sling-like apparatus. It is a frontal plan view of the triangular cradle or sling which lifts a panel of sheetrock. It is a 90 degree angle with two straps. This is held by two carriage bolts to the angle. Holes at the top of the strap are held together by a threaded connector. As shown in FIG. 5, the sling is comprised of two flat steel straps 43 joined with a 90 degree angle 41 attached at each corner by carriage bolts 42 with holes in the end to be attached by the threaded connector hook 44, attached to a metal ring 45. The threaded connector and hook 44, 45 are utilized to hook the strap portion to the cable with rope thimble secured by a cable nut 46.

I claim:

1. A panel lifting device, comprising:

a cradle, said cradle having a plurality of support members, with a base support member defining an "L" shaped cross-section, wherein said cradle is triangular-shaped;

an elongated frame member, said elongated frame member comprising a plurality of slidably-related segments, with one said segment of said plurality of slidably-related segments having a base member proximate a distal end, and wherein a plurality of height-adjustment apertures are defined in said plurality of slidably-related segments of said elongated frame member;

a plurality of height-adjustment pins, each said pin removably secured through said height-adjustment apertures of said plurality of slidably-related segments;

a winch, said winch secured to said elongated frame member;

a pulley, said pulley carried by said elongated frame member; and a cable, said cable winded coiledly related to said winch, extending through said pulley, and removably affixed to said cradle.

2. The panel lifting device of claim 1, wherein said base member is swivelably carried by said elongated frame member.

3. The panel lifting device of claim 1, further comprising a clip, said clip carried by said elongated frame member.

4. The panel lifting device of claim 1, wherein said plurality of intermating segments is three.

5. The panel lifting device of claim 1, wherein said winch comprises an internal cable lock and one-way ratchet handle.

6. The panel lifting device of claim 1, wherein said winch is secured relative to said elongated frame member via a mounting bracket plate, a plurality of bolts, and a plurality of locking pins.

7. The panel lifting device of claim 6, further comprising a transport support member carried proximate said winch, wherein said transport support member is adapted to receive a locking pin therethrough and wherein said transport support member is adapted to receive at least one of said plurality of slidably-related segments of said elongated frame member and retain via said locking pin.

8. The panel lifting device of claim 1, further comprising a bar, said bar having an L-shape cross-section, and said bar removably carried proximate a proximal end of one said segment of said plurality of slidably-related segments at a position perpendicular thereto.

9. The panel lifting device of claim 1, further comprising a cable retaining clip carried by said elongated frame member proximate said pulley, and a bolt, said bolt extending through said elongated frame member and rotationally supporting said pulley.

10. The panel lifting device of claim 1, wherein said triangular cradle defines a right triangle, wherein said base frame support member is secured to each second and third frame support member via a carriage bolt, wherein said second and third frame support members are secured via a threaded connecting ring member, and wherein said cable carries a rope thimble, cable nut, and ring, said ring removably secured to said threaded connecting ring member.

11. A panel lifting device, comprising:

a cradle, said cradle having a plurality of support members, with a base support member defining an "L" shaped cross-section;

an elongated frame member, said elongated frame member comprising a plurality of slidably-related segments, with one said segment of said plurality of slidably-related segments having a base member proximate a distal end, and wherein a plurality of height-adjustment apertures are defined in said plurality of slidably-related segments of said elongated frame member;

a plurality of height-adjustment pins, each said pin removably secured through said height-adjustment apertures of said plurality of slidably-related segments;

a winch, said winch secured to said elongated frame member;

a pulley, said pulley carried by said elongated frame member;

a cable, said cable winded coiledly related to said winch, extending through said pulley, and removably affixed to said cradle; and a bar, said bar having an L-shape cross-section, and said bar removably carried proximate a proximal end of one said segment of said plurality of slidably-related segments at a position perpendicular thereto, wherein said bar further comprises a dual-flange mount with two central pin receiving apertures defined therein, said dual-flange mount carried proximate a midpoint of said bar, wherein said proximal end of said one segment of said plurality of slidably related segments further comprises two pin receiving apertures, and further comprising a locking pin adapted to extend therethrough.

* * * * *